United States Patent [19]

Moyer

[11] 4,444,140

[45] Apr. 24, 1984

[54] METHOD OF MAKING PANTY HOLE AND APPARATUS TO MAKE SAME

[75] Inventor: Charles R. Moyer, Charlotte, N.C.

[73] Assignee: Monarch Knitting Machinery Corporation, Glendale, N.Y.

[21] Appl. No.: 330,654

[22] Filed: Dec. 14, 1981

[51] Int. Cl.[3] ..... D05B 1/00; D05B 21/00; D05B 37/04; D05C 9/04

[52] U.S. Cl. ..... 112/262.2; 112/262.3; 112/121.15; 112/121.29

[58] Field of Search ..... 112/262.2, 262.3, 121.15, 112/121.29, 10; 223/43

[56] References Cited

U.S. PATENT DOCUMENTS

| | | | |
|---|---|---|---|
| 3,777,681 | 12/1973 | Horita | 112/121.15 |
| 3,871,309 | 3/1973 | Frost | 112/121.29 |
| 3,941,069 | 3/1976 | Fukuyama | 112/121.15 |
| 4,102,284 | 7/1978 | Rohr | 112/121.29 |
| 4,214,541 | 7/1980 | Zeigler et al. | 112/262.3 |

*Primary Examiner*—Ronald Feldbaum
*Attorney, Agent, or Firm*—Nathan Levin

[57] ABSTRACT

Improvement in the manufacture of panty hose wherein instead of making the panty portion of the panty hose on one machine, known as a Line Closer, and of closing the open toe foot portions of the panty hose on another machine, known as a Toe Closer, to make the panty hose, the panty hose is now made entirely upon an apparatus which combines the functions of both machines to make the panty hose. The apparatus includes an attachment to be used in conjunction with a Line Closer in which the latter makes the panty portion of the panty hose in the usual way from the welt portions of a pair of hosiery blanks having open welt, leg and open toe foot portions and in which the attachment then automatically transfers the hosiery blanks from the Line Closer to itself and sews closed the open toes of the foot portions to make the panty hose.

7 Claims, 22 Drawing Figures

METHOD OF MAKING PANTY HOSE AND APPARATUS TO MAKE SAME

Figure 1:
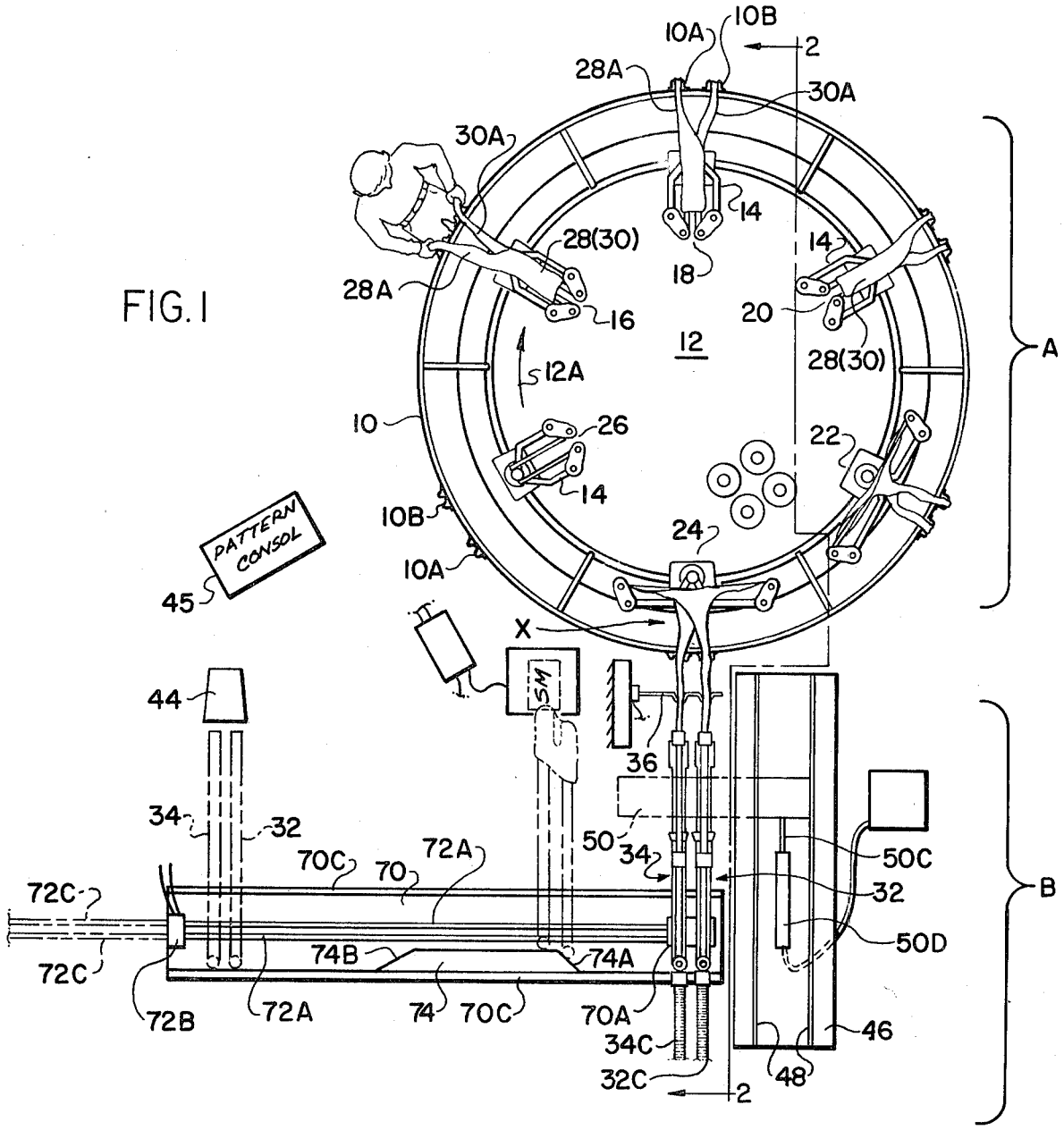

The present invention relates to an improvement in the apparatus for and in the method of making panty hose of the type having panty, leg and foot portions from pairs of individual ladies seamless knitted tubular hosiery blanks each of which has open welt, leg and open toe foot portions. The welt portions of each pair of the hosiery blanks are slit and are then sewn together to form the panty portions of the panty hose while the open toe foot portions of the pair of hosiery blanks are each sewn closed to form the foot portions of the panty hose, with the leg portions of the pair of hosiery blanks forming the leg portions of the panty hose.

Heretofore, the operations of making the panty portions and of closing the open toe foot portions of this type of panty hose have been separate and have been carried out upon separate machines. The panty portions have been made upon a machine shown in U.S. Pat. No. 3,777,681 and in machine Models LC-240-B and LC-320, made by the Takitori Machinery Mfg. Co., Ltd., of Japan, which machine is known as a 'Line Closer'; while the closing of the open toe foot portions has been done upon a machine shown in U.S. Pat. Nos. 3,941,069 and 4,133,280, which machine is known as a 'Toe Closer'.

The Line Closer, which sews a U-shaped crotch closing seam in the panty portion of the panty hose, is equipped with six spaced heads mounted upon a turntable which moves in one direction past a like number of operating stations. An operator, at station one, keeps loading each passing head of the machine, in turn, by placing the welt portions of a pair of the hosiery blanks, usually having closed toe foot portions, in side by side relation over two pairs of hinged clamping boards wherein the welt portions of the hosiery blanks are clamped together. At station two, the adjacent inner sides of the clamped together welt portions of the hosiery blanks are cut walewise. At station three, the clamping boards swing open so that the cut edges of the still clamped welt portions of the hosiery blanks are spread to extend in a straight line. At station four, the cut edges are sewn together to form the crotch closing seam. At station five, the clamping boards are unclamped to return to their original positions and at the same time to permit unloading of the finished panty hose from the machine which takes place at station six.

It will be noted that after the loading operation of each pair of the hosiery blanks at each head of the Line Closer, the leg and foot portions of each such pair of hosiery blanks are normally in contact with each other, in side by side relation, as they hang freely downward from the clamped welt portions thereof and normally remain in such relation to each other for the remainder of the machine operations.

The Toe Closer, which sews the open toe foot portions of the hosiery blanks closed, is equipped with a series of spaced horizontally disposed and lengthwise extending parallel hosiery forms to receive the hosiery blanks. Each hosiery form is provided with a suction tube and with a pair of laterally expandable side pieces flanking opposite sides thereof, with the forms moving in an endless oval-shaped pathway past a loading and a number of other following operating stations. An operator keeps loading the forms, in turn, at the loading station by placing individual ones of the open toe foot portions of successive hosiery blanks in position to be individually sucked into each of successive tubes of the forms. At the same time, the operator reverse folds the welt portions of the hosiery blanks over the ends of the tubes to encircle the same. Then a rotary wheel engages with and draws the hosiery blanks lengthwise upon the forms, to a predetermined position, thereby to reverse the hosiery blanks upon the forms while leaving the open toe ends of the foot portions extending just beyond the ends of the forms. The side pieces, which are enclosed within the hosiery blanks, are then spread laterally to engage with, to spread, to hold and to move such open ends of the foot portions past a sewing machine which sews them closed. Thereafter, the closed foot hosiery blanks are each reversed again upon its associated form and is discharged from the machine.

In the operation of making the panty hose separately upon the Toe Closer and upon the Line Closer, it will be noted that the hosiery blanks must each be hand placed upon each of the two machines by an operator, that the semi-finished panty hose discharged from one machine must be handled and transported to the other machine, and that the services of at least two operators are required for such operations.

In the present invention, the cost of making the panty hose in question is reduced by combining, in a single new machine, the functions of the two machines, i.e., the Toe Closer and the Line Closer, whereby handling of the semi-finished panty hose is eliminated and wherein the services of only a single operator is required to attend to the combination machine. Also, a novel method of making the panty hose is provided.

While it is the usual practise to first close the open toe foot portions of the hosiery blanks upon the Toe Closer and then to form the panty portions on the Line Closer when the panty hose is made upon the two machines, in the present invention in which the panty hose is formed upon a novel single machine, the panty portions are formed first and then the open toe foot portions are closed.

In the operation of the machine of the present invention, an operator first loads each head, in turn, as in the Line Closer, and then laterally separates the freely downwardly hanging foot and leg portions of each pair of the hosiery blanks. Further operations, similar to those of the Line Closer, continue with the leg and foot portions remaining separated. After sewing together the cut edges of the welt portions and while they are clamped together in a straight line, the laterally spaced leg and foot portions of the hosiery blanks are individually sucked into each of a pair of suction tubes of a spaced pair of conventional hosiery blank receiving forms. Then the sewn together welt portions of the hosiery blanks, while still in a straight line, are removed from clamping boards holding the same, (the boards being unclamped at this time to permit such action) are rotated ninety degrees, and are reversely folded over the ends of and upon the respective forms to encircle the same. Drawing on wheels are then actuated to draw the semi-finished panty hose lengthwise along the outer side of the forms to reverse the same on the forms and at the same time to position the open toe ends of the foot portions just past the ends of the forms. The side pieces then expand to engage the open toe ends and to move the same past a sewing machine to sew the toe ends of the foot portions closed. Thereafter, the completed panty hose is reversed on the forms by the suction tubes thereof and is discharged from the machine.

It is the object of the present invention to provide a novel machine, and method of operation, for the formation of panty hose in a continuous process wherein pairs of hosiery blanks have their welt portions sewn together by the machine to make the panty portions of the panty hose at the same time that other pairs of such semi-finished panty hose are having their open toe foot portions sewn closed by the machine.

It is a further object of the present invention to provide a method of making panty hose of the type having toe closing seams wherein the seams are automatically disposed in a preferred relation in the panty hose during the making thereof whereby the seams extend around the toes of the feet of the wearer of the panty hose.

With the above and other objects in view as will become apparent from the accompanying drawings and the description thereof, the invention resides in an improvement in apparatus for and in a method of making panty hose as shown and as described, and as set forth in the appended claims.

Figure 2:
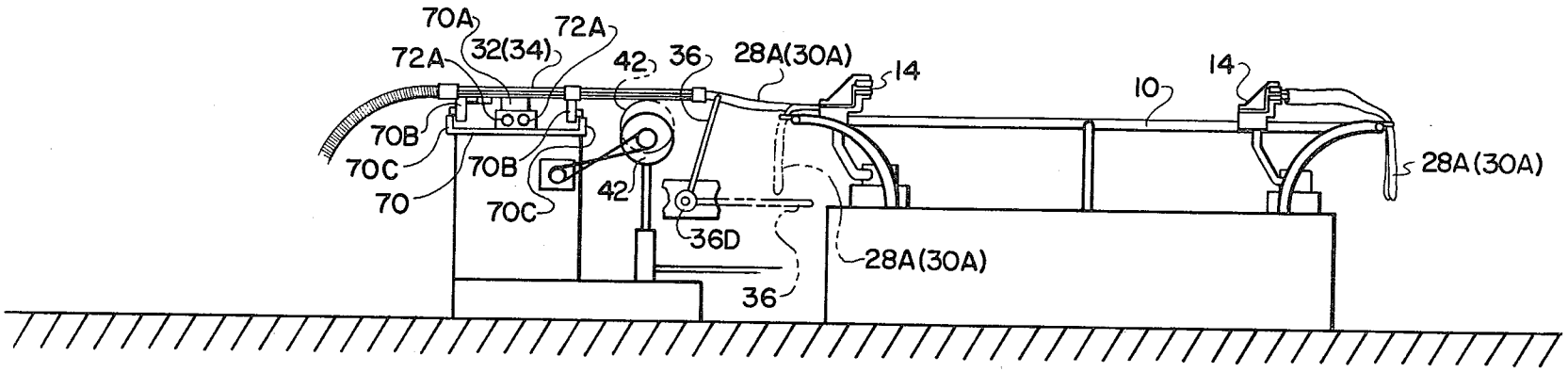
Figure 15:
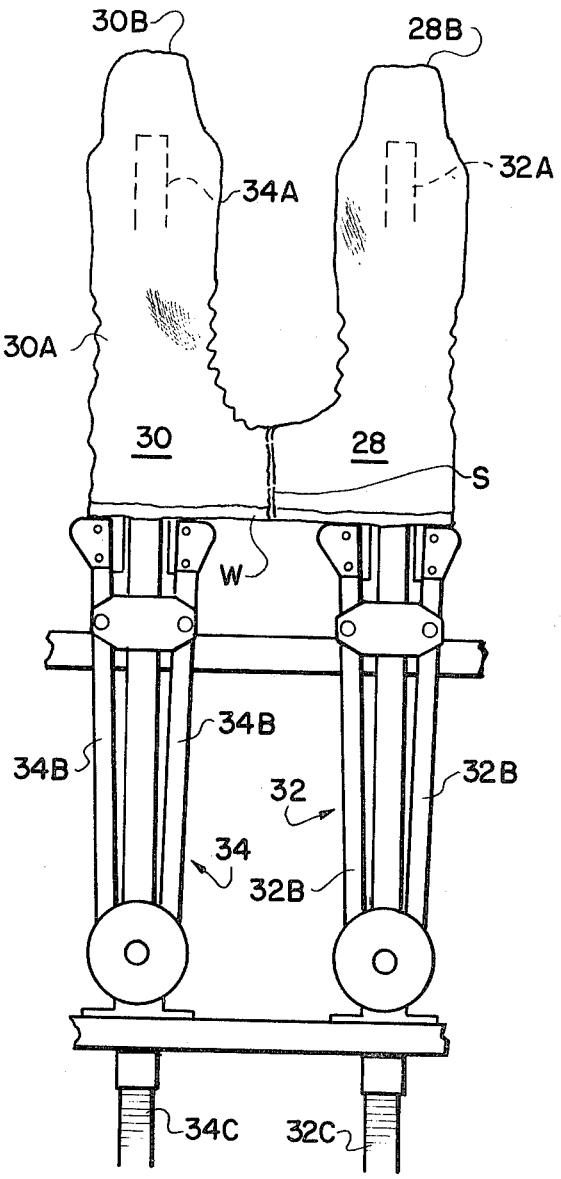
Figure 16:
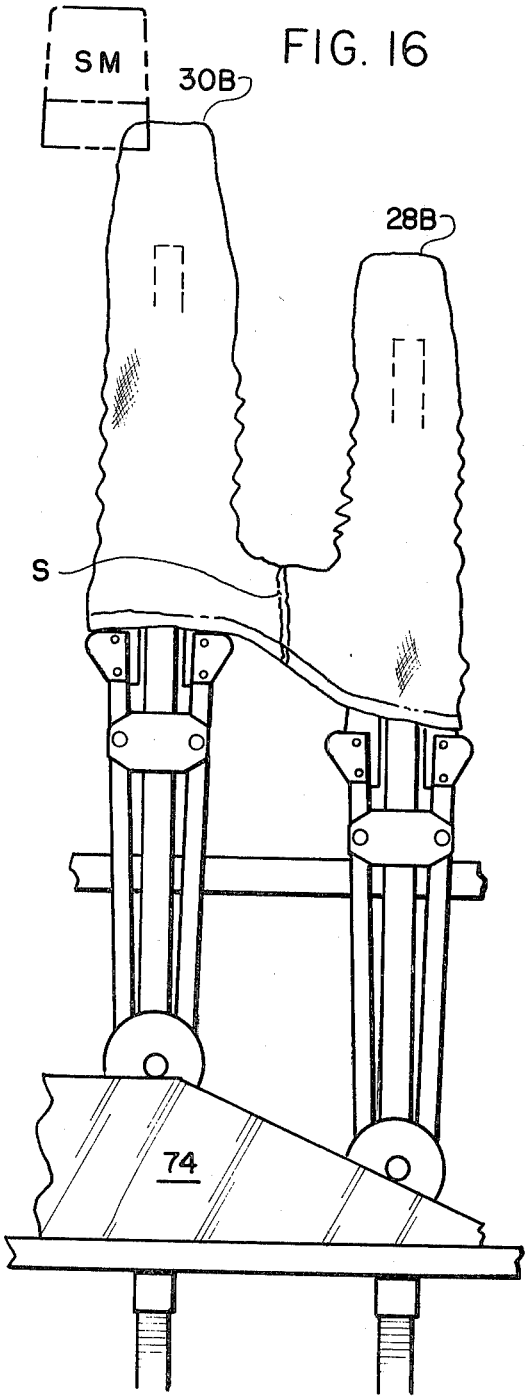
Figure 17:
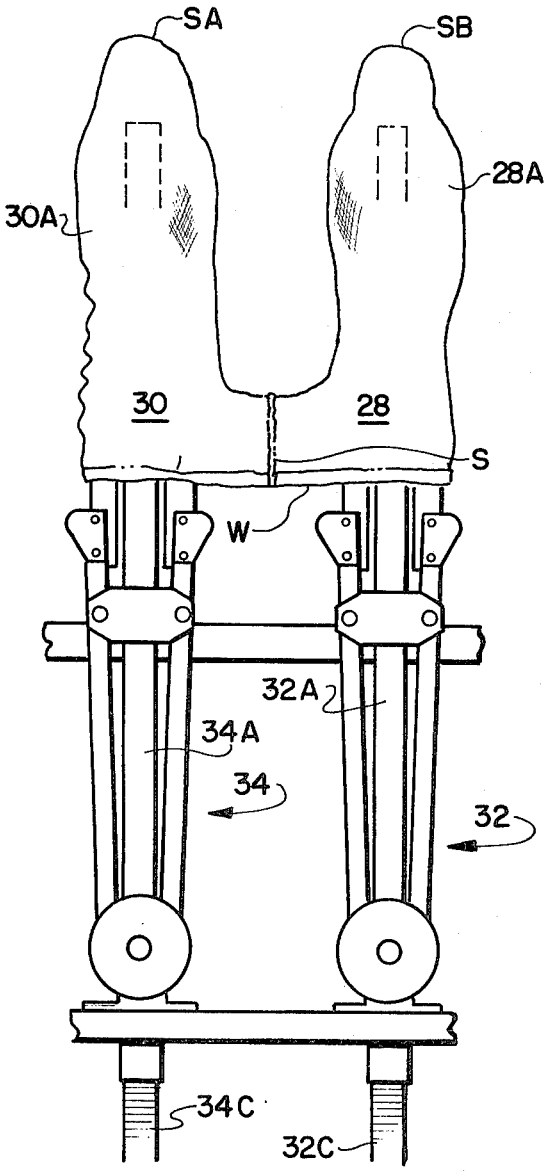
Figure 18:
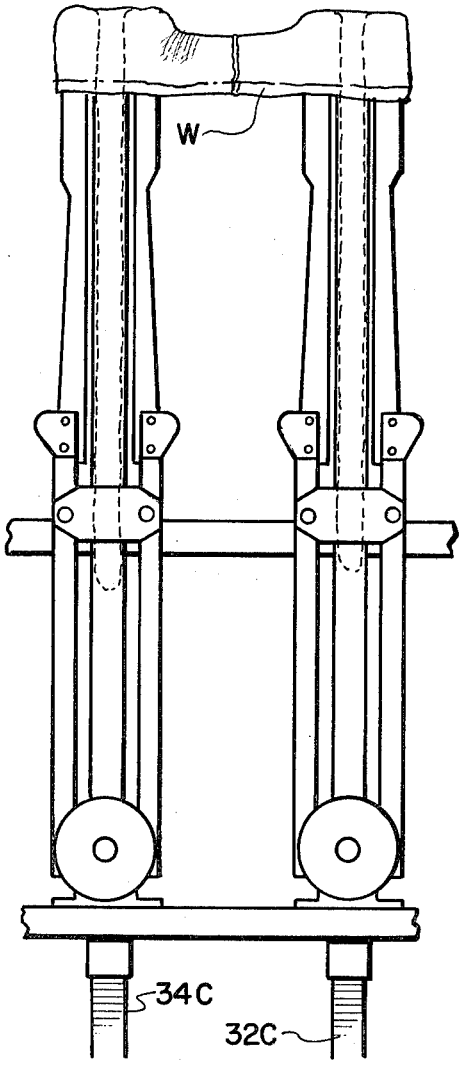
Figure 19:
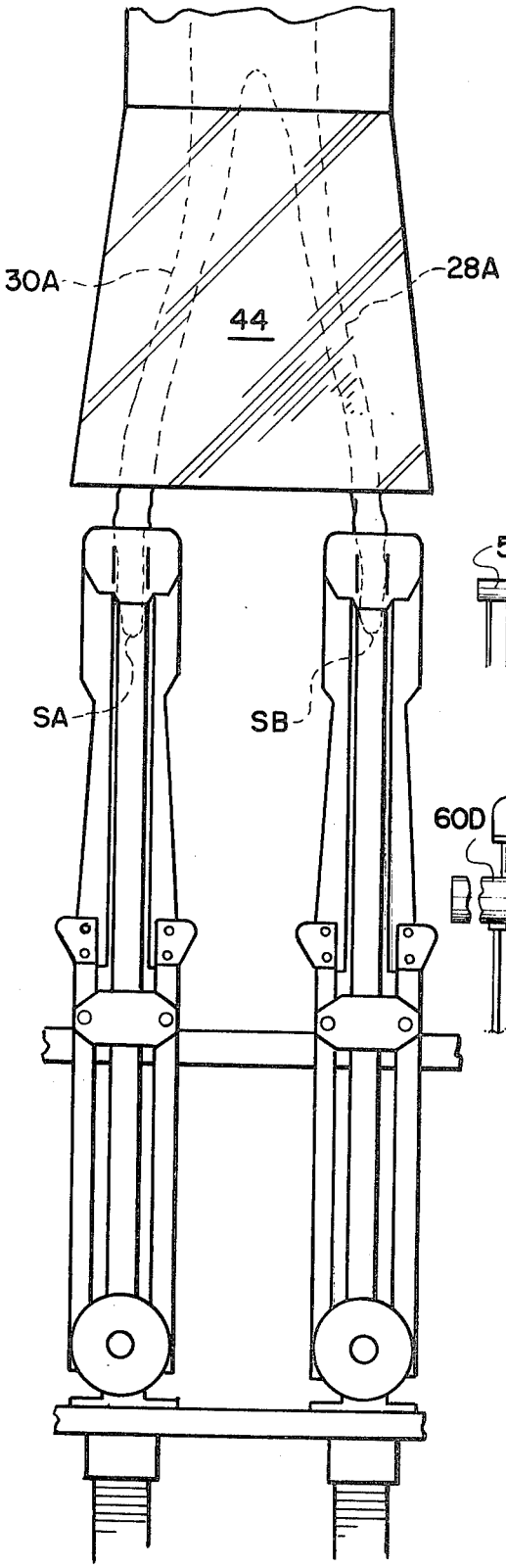
Figure 20:
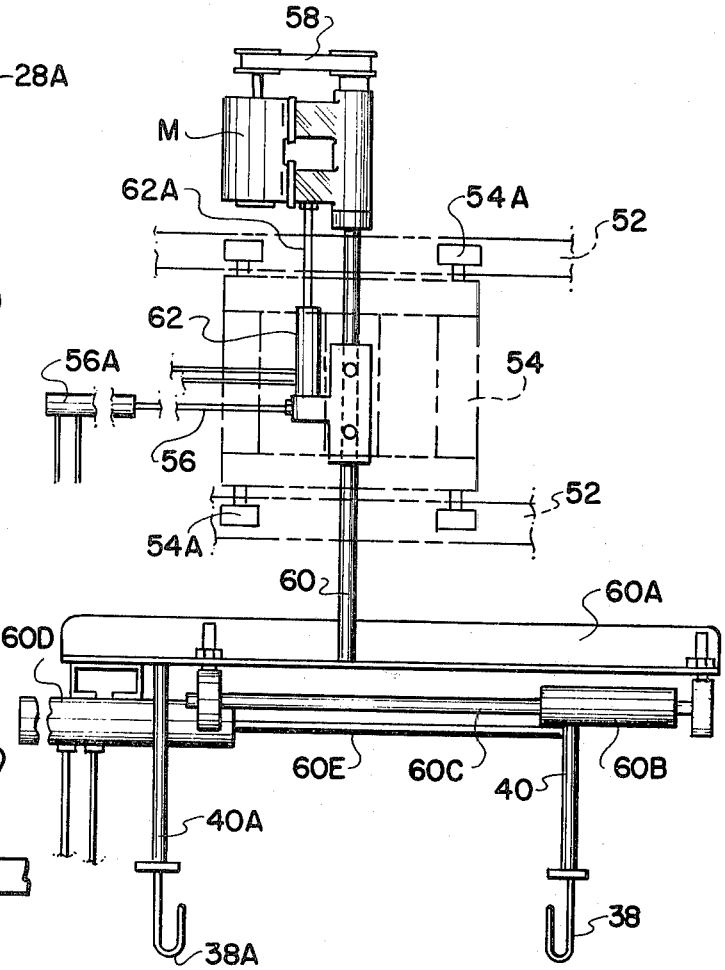
Figure 22:
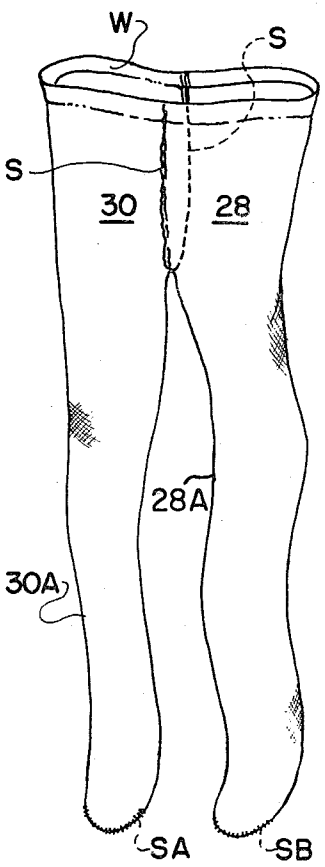
Figure 21:
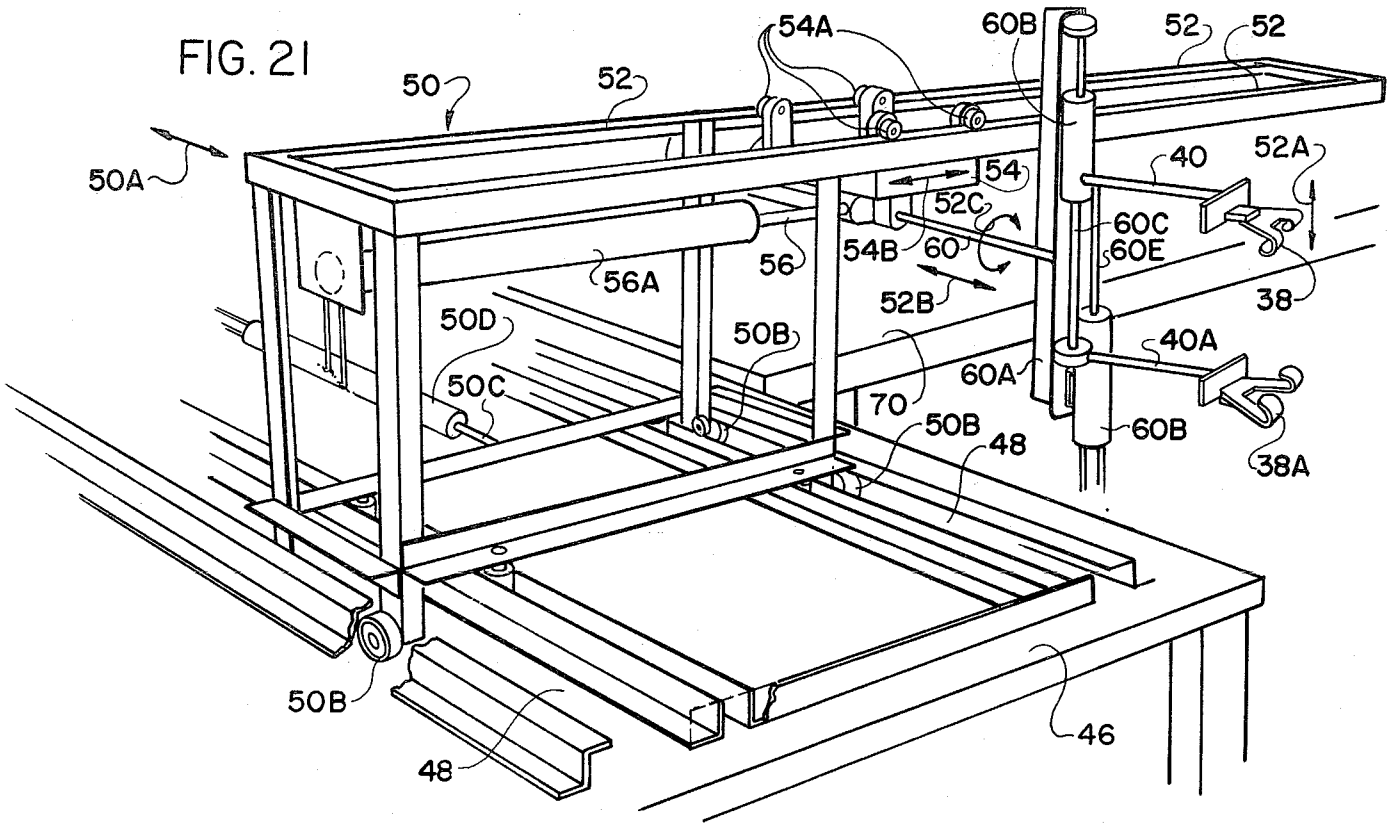

In the drawings:

FIG. 1 ia a plan view of the apparatus of the present invention showing first and second parts thereof in which the first part makes semi-finished panty hose which is then transferred to the second part of the apparatus which finishes the making of the panty hose, FIG. 2 is a cross sectional side view of the apparatus of FIG. 1 as taken on lines 2—2 thereof, FIGS. 3 through 15 are views showing successive stages in the transfer of the semi-finished panty hose from the first part to the second part of the apparatus, FIG. 16 is a plan view of the semi-finished panty hose on a pair of hosiery blank receiving forms and moving toward a sewing machine to sew the open toe foot portions closed, FIG. 17 is a view similar to FIG. 16 showing the closed foot portions of the panty hose, FIG. 18 is a view similar to FIG. 17 showing the removal of the finished panty hose from the forms, FIG. 19 is a view similar to FIG. 18 showing the discharge of the finished panty hose from the forms, FIGS. 20, 21 are views showing the first and second parts of the apparatus used in operating the transfer hooks to transfer the semi-finished panty hose from the first to the second parts of the apparatus and in sewing the toes closed to complete the panty hose, and FIG. 22 is a view of a pair of panty hose made according to the method of the present invention.

While the means of the present invention may be referred to as a machine, as a pair of machines, or as an apparatus, which combines the functions of the conventional Line and Toe Closers, it may also be referred to as an attachment for the Line Closer inasmuch as the latter continues to make the panty portion of the panty hose in conventional manner. The means, as an attachment, transfers the semi-finished panty hose from the Line Closer to itself and then acts thereon to close the open toe portions of such panty hose. Hereinafter such means is referred to as an 'apparatus'. The term 'semi-finished' as applied to the panty hose is intended to refer to a pair of the hosiery blanks after their welt portions have been joined to form the panty portion of the panty hose and before the open toe foot portions of the hosiery blanks have been closed.

The apparatus of the present invention, FIG. 1, as shown is divided into two parts, A and B, of which part A is a slightly modified Line Closer and forms semi-finished panty hose from pairs of ladies seamless knitted tubular hosiery blanks, each of which has open welt, leg and open toe foot portions, as generally disclosed in U.S. Pat. No. 3,777,681, while the part B automatically transfers the semi-finished panty hose from part A to itself and then closes the open toes thereof by sewing, as generally disclosed in U.S. Pat. No. 4,133,280. While the parts A and B of the apparatus are not physically connected, they are joined, in turn, by each of the panty hose being made, one such panty hose being shown at X in FIG. 1 wherein the panty portion thereof is retained in part A while the leg and foot portions thereof have been transferred to and are retained in part B of the apparatus.

A circular guide rail 10, FIGS. 1, 2, in part A of the apparatus, is positioned above, moves with, and encircles a turntable 12 having six spaced heads 14 thereon and which moves in the direction of arrow 12*a* past each of six operating stations 16 through 26. A pair of spaced U-shaped brackets 1O*a*, 1O*b* is secured on the outer circumference of ring 12 opposite each head 14. At station 16, an operator loads each of the heads 14, in turn, in the usual manner, by clamping therein the welt portions of a pair of hosiery blanks 28, 30 without establishing any special relation between such welt portions and the apparatus or between the welt portions during the loading thereof. A special relation between such welt portions and the apparatus as well as between the welt portions being loaded would have been desirable if the toe portions of the pair of hosiery blanks had previously been sewn closed so that the toe closing seams could then have a preferred relation in the finished panty hose to the crotch closing seam still to be sewn into the welt portions of the hosiery blanks. It will be noted that such a preferred relation between the crotch and the toe closing seams in the finished panty hose results automatically from the operation of the present apparatus and without any assistance from an operator. Thereafter, instead of allowing the leg and foot portions 28*a*, 30*a* to hang down freely together in random fashion over the rail, the operator separates such leg and foot portions and places portion 28*a* within bracket 1O*a* and portion 30*a* within bracket 1O*b* so that the leg and foot portions hang down freely over rail 10 in laterally spaced relation. The leg and foot portions 28*a*, 30*a* remain so separated while the hosiery blanks pass by and are operated upon in the usual manner at stations 18, 20, 22 and 24 during which the welt portions of the hosiery blanks have been clamped together between pairs of clamping boards, have been cut walewise, have been spread to extend the cut edges in a straight line, and have been sewn together along the cut edges. At station 24, the semi-finished panty hose is complete and is in position to be transferred to part B of the apparatus. At this time the sewn together portions of the hosiery blanks are still clamped together in a head 14 and extend in a straight line with their spaced leg and foot portions hanging over rail 10.

Figure 3:
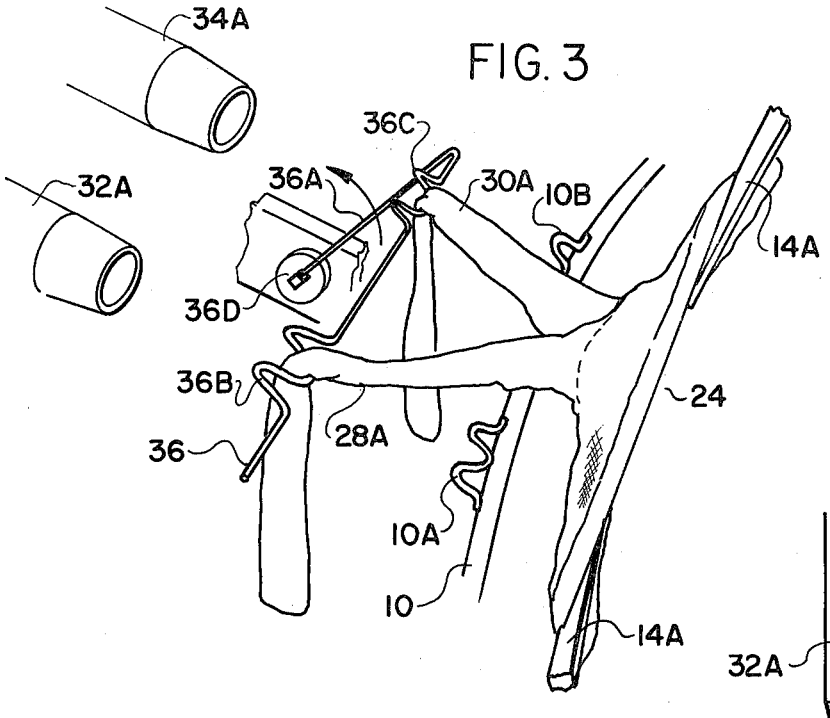
Figure 4:
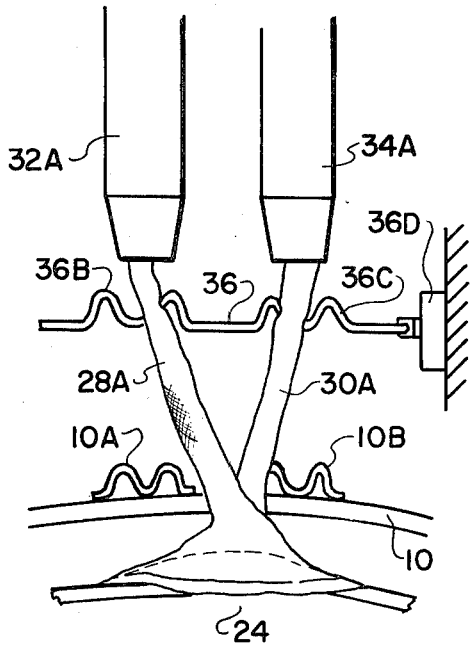
Figure 5:
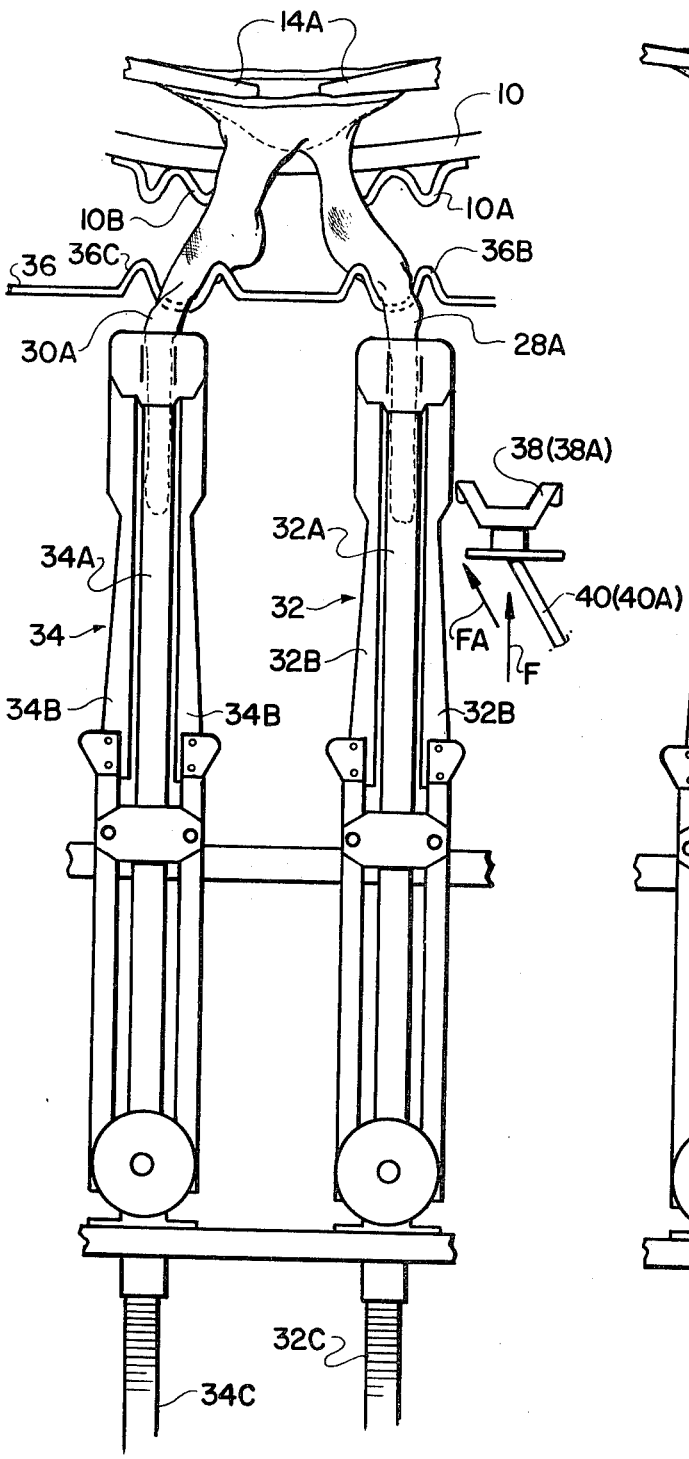
Figure 6:
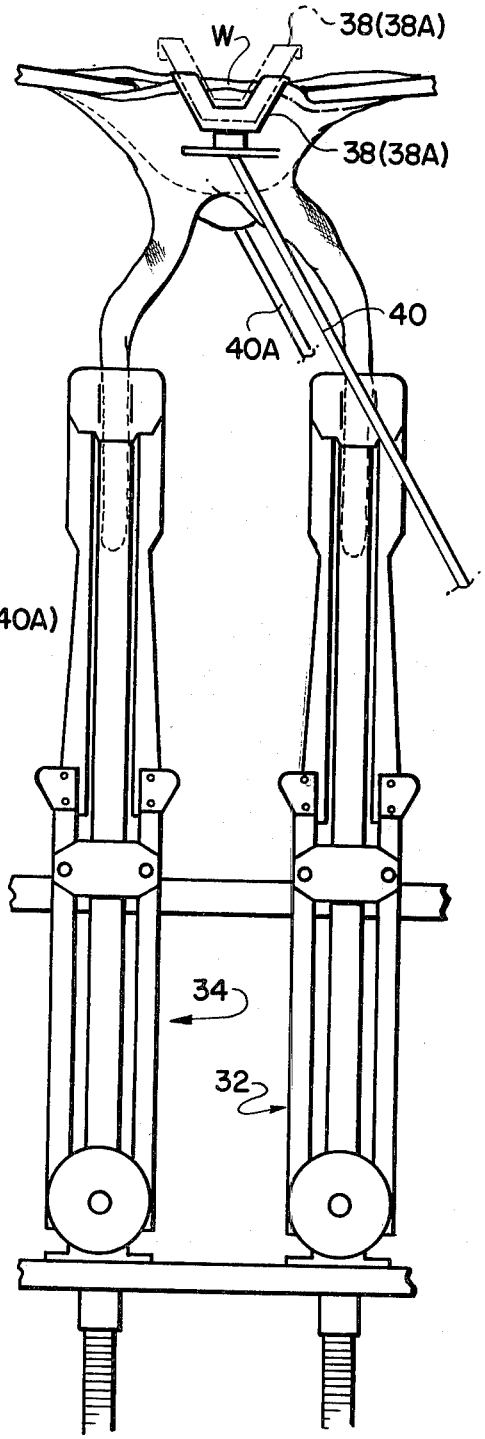
Figure 8:
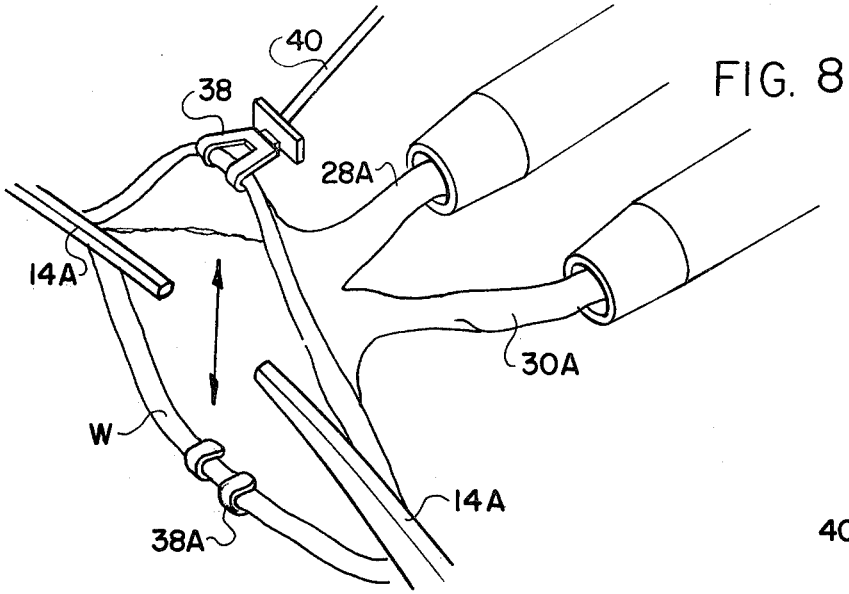

In part B of the apparatus, FIGS. 1, 2, there is a pair of spaced parallel horizontally disposed conventional hosiery blank receiving forms 32, 34 having suction tubes 32*a*, 34*a*, FIG. 3, and pairs of laterally expandable side pieces 32*b*, 34*b*, FIG. 5, flanking opposite sides of each of the suction tubes. Suction is provided as needed to the tubes, under pattern control, by flexable tubes 32*c*, 34*c*. The forms are at station 24 outside ring 10 opposite a head 14 and extend radially of the turntable 12. It is within tubes 32*a*, 34*a* that leg and foot portions 28*a*, 30*a* of the semi-finished panty hose are to be drawn by suction while the panty portion of the panty hose is still clamped in a head 14. To this end there is provided an L-shaped transfer member having a horizontal arm 36 and an adjoining arm 36*a* at right angle thereto. A pair of U-shaped spaced fabric receiving brackets 36*b*, 36*c*, similar in size, shape and spacing to brackets 1O*a*, 1O*b* on ring 10, are formed in arm 36 while arm 36*a* is pivotally mounted at its other end in a rotary solenoid 36*d*. The solenoid acts to oscillate the transfer member, as needed, under pattern control. The transfer member 36, FIG. 2, is shown in its inactive dotted line horizontal position, and also in its active full line position after being turned by the solenoid. Each semi-finished panty hose comes to station 24 with its separated leg and foot portions, shown in dotted lines, hanging over rail 10 and above the transfer member in its lower inactive position. The solenoid is actuated and the transfer member is turned to come up under the leg and foot portions to raise the same, FIG. 3, to the level of forms 32, 34, during which leg portion 30*a* is caught in bracket 36*c* and leg portion 28*a* is caught in bracket 36*b*. With the parts in this position, suction is turned on in tubes 32*a*, 34*a* to suck the leg and foot portions 28*a*, 30*a* into tubes 32*a* and 34*a*, as shown in FIGS. 1, 2, 4. The panty portion of the semi-finished panty hose is still clamped in a head 14 at this time, being held there by spaced clamping arms 14*a*, 14*a*.

Figure 7:
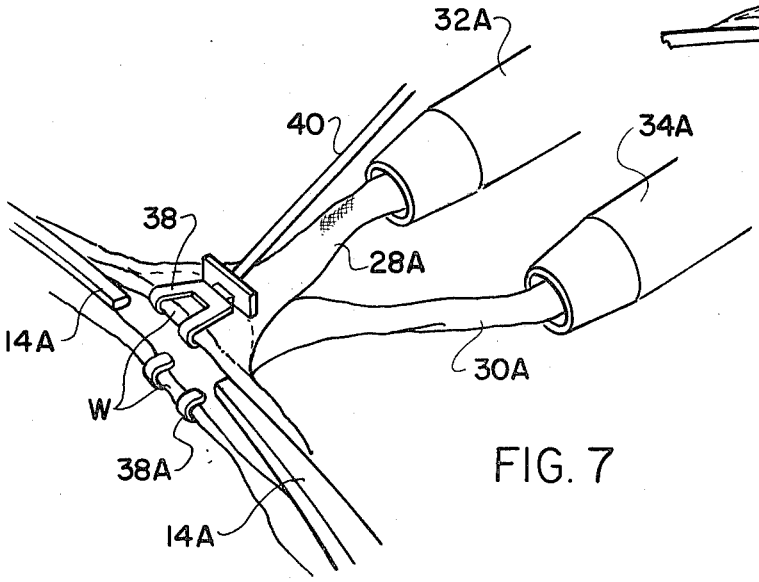
Figure 9:
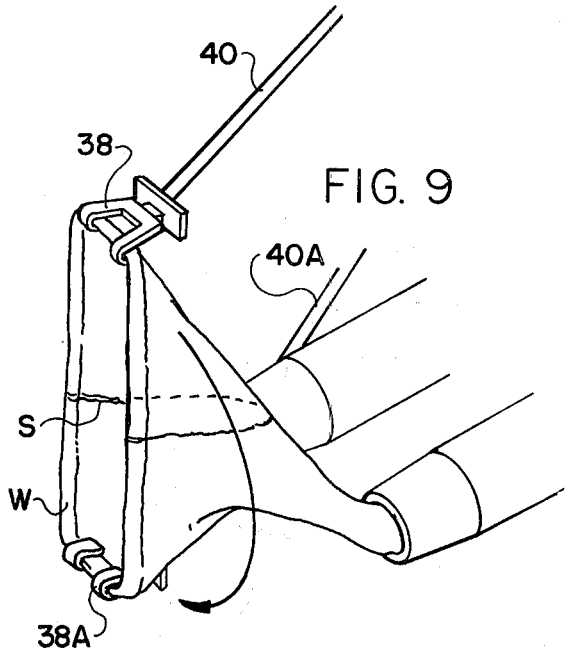
Figure 10:
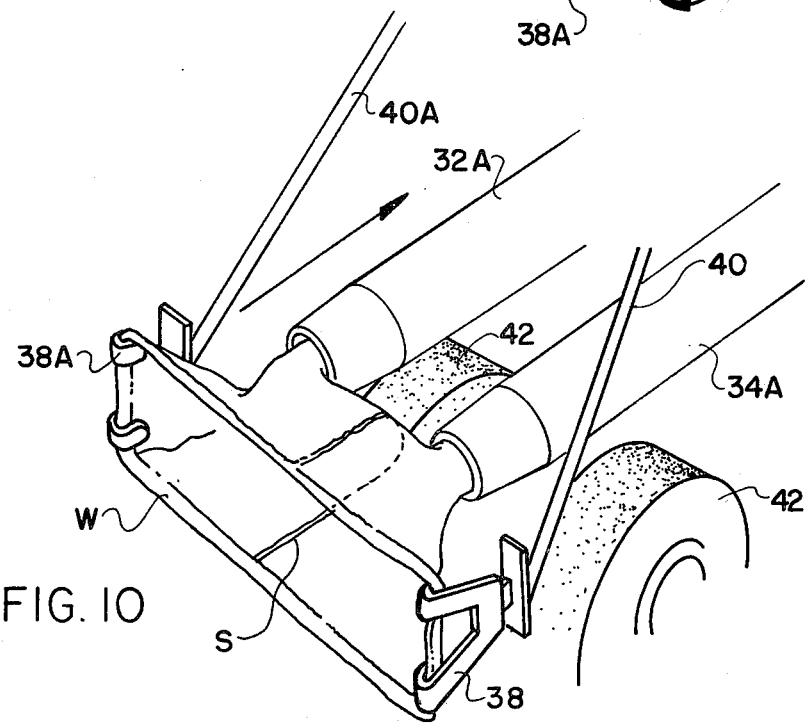
Figure 11:
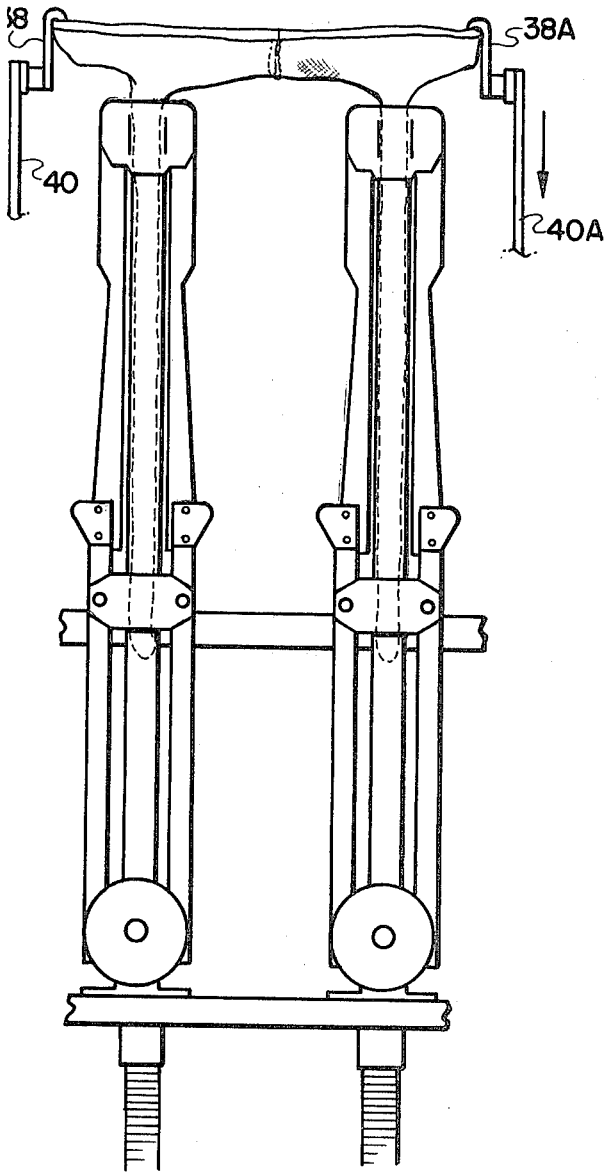
Figure 12:
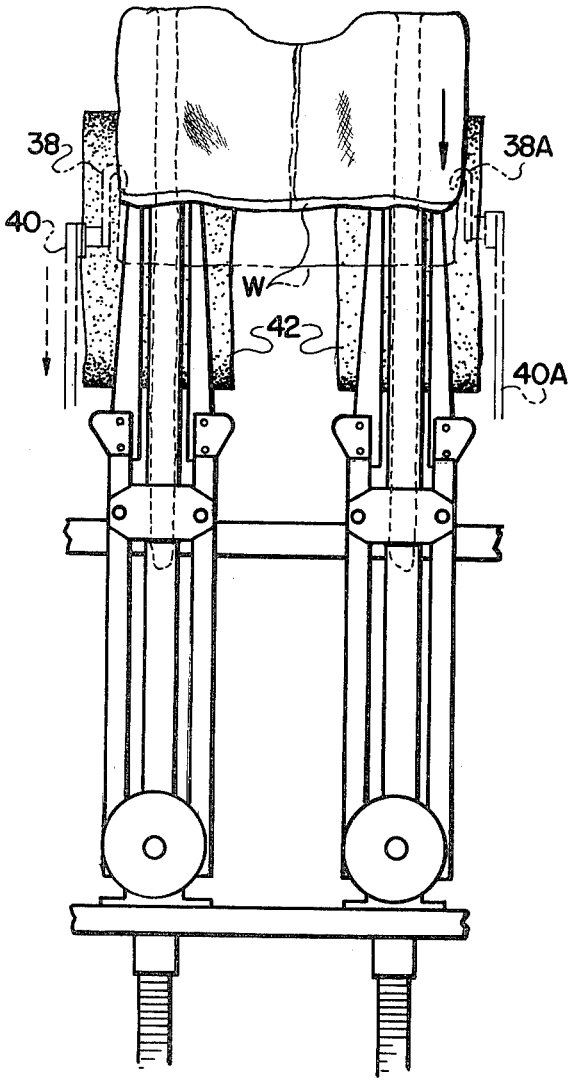
Figure 13:
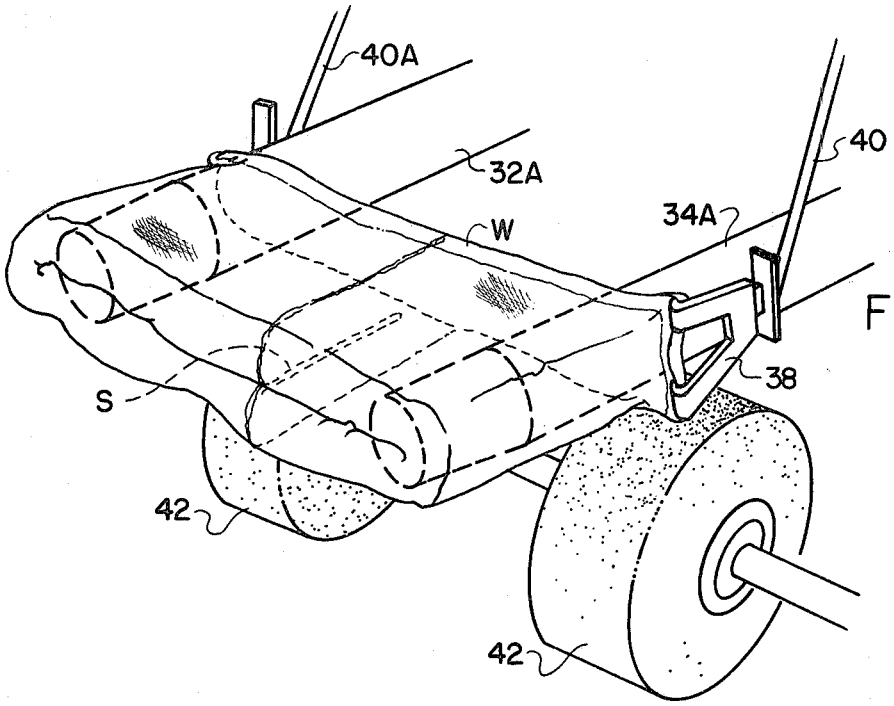
Figure 14:
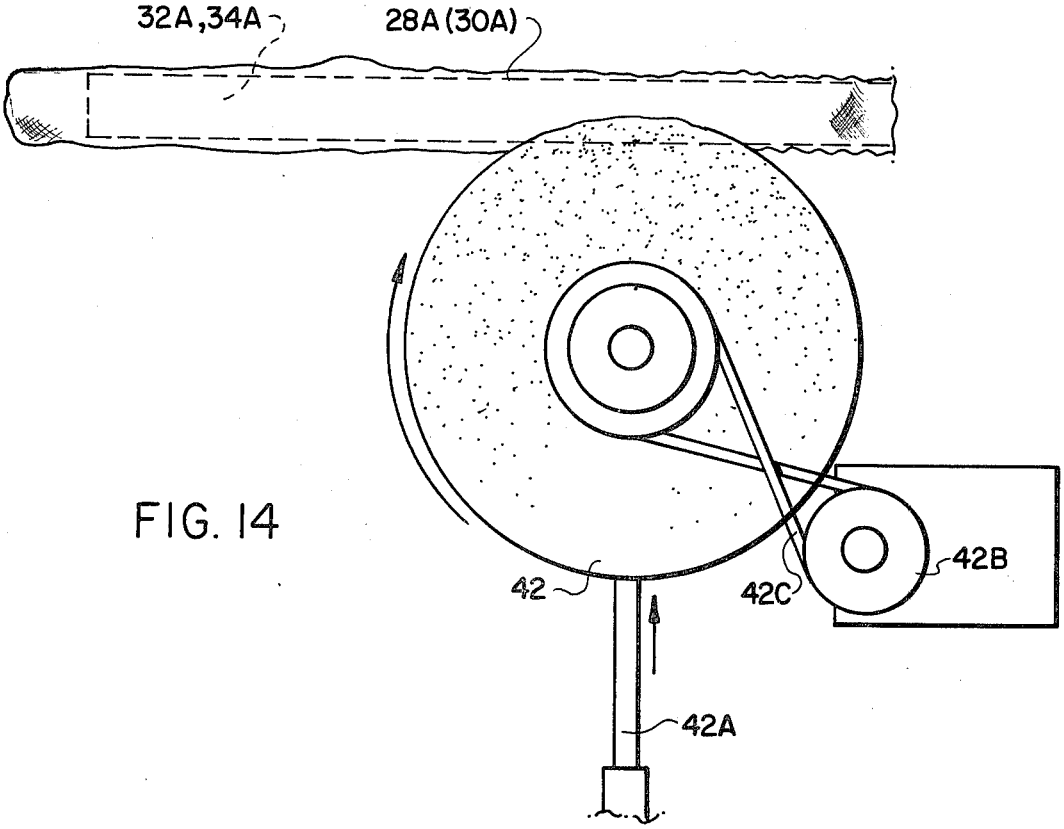

A pair of transfer hooks 38, 38*a* at the ends of arms 40, 40*a* is provided to remove the panty portion of the panty hose from a head 14 to a reversed position over the ends of forms 32, 34 to encirclr the same. The transfer hooks are movable, under pattern control, to a number of positions in three dimensions and, at the same time, the distance between them may be adjusted. The means to so move the transfer hooks will be described later in connection with FIGS. 20, 21 and meanwhile only the positions of the hooks will be set forth as they move the panty hose being made. Starting with the transfer hooks in zero position, FIG. 5, they move both forward and to the left, in the directions of arrows F, Fa until they reach their dotted line position of FIG. 6 in which the hooks are just beyond the upper edge W of the clamped waist band of the semi-finished panty hose. The hooks are yieldingly biased toward each other and are spaced to engage opposite spaced portions of the upper edge W of the waist band after which they are retracted to their full line position of FIG. 6. At this time the parts are as shown in FIG. 7 with clamps 14*a* still holding the panty portion. The ends of clamps 14*a* are spaced and it is between the same that the hooks move to engage the panty. Then, FIG. 8, the hooks move vertically away from each other, in the directions of the double headed arrow, to spread open the panty with the clamps 14*a* still holding the same. In FIG. 9 the clamps have been removed to release the panty of which the waist band opening now extends vertically, and, as shown by the circular arrow, the hooks and the opened panty are rotated ninety degrees to the position shown in FIGS. 10, 11. Then the hooks are withdrawn in the direction of the arrows, FIG. 10, and this draws the opened panty over the ends of forms 32, 34 as shown in FIGS. 12, 13 to a position over spaced draw-on wheels 42, 42, below and aligned with forms 42, 42. The wheels, under pattern control, are raised from their full line idle position, FIG. 2, to their dotted line active position by a ram 42*a*, FIG. 14, to contact the panty on the forms. The motor 42*b* rotates the wheels in the direction shown whereby the wheels draw on the panty for a predetermined distance but leave the ends of the foot portions to extend just past the ends of tubes 32*a*, 34*a*, FIG. 14. At the same time such movement of the panty withdraws the waist thereof from the transfer hooks which then return to zero position.

The semi-finished panty is now fully reversed (wrong side out) on the forms 32, 34, FIG. 15, with open toe ends 30*b*, 28*b* just beyond the ends of tubes 34*a*, 32*a*, and with side pieces 34*b*, 34*b* and 32*b*, 32*b* in expanded positions. The forms 32, 34 and the panty thereon now move to the left, FIG. 16, and also move individually and progressively toward a sewing machine SM, and as they pass the same the open ends 30*b*, 28*b* are sewn closed by seams Sa and Sb as in FIG. 17, with the side pieces expanded. The forms now move away from the sewing machine to position of FIG. 17 with the panty hose fully formed and inside out. At this time the side pieces are returned to non-expanded condition and suction is turned on, under pattern control, in tubes 32*a*, 34*a*, and this draws panty legs 28*a*, 30*a*, toe ends first, back into the tubes. After the panty legs have gone as far as they can go into the tubes, the suction is reversed and compressed air is directed into the tubes and this expels the panty legs from the tubes, as in FIG. 19 where the panty hose, now right side out, is discharged into a container 44. The forms 32, 34 travel back and forth from their full line position to the left in FIG. 1 to a dotted line position opposite the sewing machine and then further to the left to a position opposite container 44, and then returns to its full line position to receive the next semi-finished panty hose.

Referring now to FIGS. 1, 2, 20, 21, the means to operate the transfer hooks 38, 38*a* and to reciprocate the forms 32, 34 will be described. On a table 46 there is a pair of spaced lengthwise extending rails 48, 48 upon which there is a trolley 50 (in dotted lines in FIG. 1) which moves back and forth, in directions of arrow 50*a* on rollers 50*b*, being so moved by a ram rod 50*c* extending from an air cylinder 50*d*, the latter being operated when desired from the pattern control. The trolley 50 has spaced side rails 52, 52 which can extend over the panty legs at station 24. Supported by rails 52, 52 is a platform 54 which has four spaced rollers 54*a* secured thereto and by means of which platform 54 moves back and forth on rails 52, 52 in directions 54*b*, the platform being moved by ram rod 56 of an air cylinder 56*a*, under pattern control. Supported on platform 54 is a reversable motor M, which through belt 58 oscillates rod 60 which, in turn, oscillates flange member 60*a* to which the transfer hooks are connected and which oscillates such hooks. Rod 40*a* connected to hook 38*a* is fast on flange 60*a* so hook 38*a* does not move relative to flange 60*a*. Rod 40 is connected to a bearing 60*b* and to hook 38. Bearing 60*b* reciprocates along guide rod 60*c* to move hook 38 to and from hook 38*a*. The bearing 60*b* is reciprocated on the guide rod 60*c* by a suitably mounted air cylinder 60*d* and ram rod 60*e*, under pattern control. The rod 60 and flange 60*a* are lengthwise reciprocated by an air cylinder 62 via ram rod 62*a* which abuts against the base of motor support M.

On a table 70 there is a mounting block 70*a* upon which the forms 32, 34 are secured and travel therewith lengthwise of the table on rollers 70*b* set on suitable rails 70*c*. A pair of pistons 72*a*, 72*a* are secured to block 70*a* to move the same and forms 32, 34 lengthwise of the table, the pistons passing through and being supported in a block 72*b* before entering cylinders 72*c*. A cam form 74 having a rise 74*a* and decline 74*b* are fixed relative to table 70 and forms 32, 34 ride up cam face 74*a* to present the panty legs 28*a*, 30*a* to the sewing machine to close the open toes. Afterward the forms ride down face 74*b* to be in position to cooperate with container 44. The movement of the forms up and down cam faces 74*b* and 74*a* as the forms move back to full line position is an idle movement.

The several motors and air operated cylinders, used to operate the apparatus in the manner set forth, are electrically connected to an operating pattern consol 45 which serves to operate the apparatus in the required timed relationship.

It will be noted that while the present invention is shown upon a Line Closer having six heads and six stations, of which station 26 is non-operative, it could just as well be carried out on a Line Closer having five heads and five operating stations.

The relation of the U-shaped crotch closing seam S and the toe closing seams Sa, Sb, FIG. 22, is such that the toe closing seams are of similar configuration and are similarly disposed on both sides of the plane of the crotch seam, with the toe seams in position to extend around the toe ends of the feet of the panty hose wearer in preferred location thereon for this type of panty hose. Such preferred location of the seams in question results automatically from rotating the semi-finished panty hose ninety degrees after the formation of seam S and before the formation of seams Sa, Sb. The said preferred location of the seams makes it unnecessary for the wearer of the panty hose to twist the hose to place the same in the preferred position on the wearer's legs.

I claim:

1. Method of operating a first machine, a second machine and a transfer attachment to make individual panty hose having panty, leg and foot portions from pairs of individual seamless tubular hosiery blanks each of which has open welt, leg and open toe portions, comprising the step of operating the first machine to form the panty portion of the panty hose from the welt portions of each such pair of hosiery blanks, the step of integrating the operation of the first machine, the second machine and the transfer attachment to automatically transfer the hosiery blanks onto the second machine from the first machine, including the step of retaining the panty portion of the hosiery on the first machine while the leg and toe portions thereof are being transferred to the second machine and the step of operating the second machine to close the open toe portions of the hosiery blanks by sewing together the open toes thereof, thereby to make the panty hose.

2. Method as in claim 1 including the step of laterally spacing the leg and foot portions of each pair thereof during the transfer operation.

3. Method as in claim 1 including the step of turning each pair of hosiery blanks 90 degrees about its lengthwise extending axis prior to the step of operating the second machine to close the open toe portions of the hosiery blanks.

4. Method as in claim 3 wherein the second machine has suction tubes, and including the step of sucking the leg and toe portions of the hosiery blanks into the suction tubes while the panty portion of the hosiery blanks is retained on the first machine.

5. Method as in claim 4 including the step of releasing the the panty portion of the hosiery blanks from the first machine and of reversing the panty portion of the hosiery blanks over the suction tubes.

6. Apparatus comprising a first machine, a second machine and a transfer device for the formation thereby of panty hose having panty, leg and foot portions from pairs of individual seamless tubular hosiery blanks each of which has open welt, leg and foot portions, the first machine having means to form the panty portion of the panty hose from the welt portions of each such pair of hosiery blanks, the transfer device having means to automatically transfer the hosiery blanks from the first machine to the second machine, means to laterally space the leg and toe portion of each such pair of hosiery blanks during the transfer thereof from the first to the second machine and the second machine having means to close the open toe portions of the hosiery blanks by sewing together the open toes thereof, thereby to form the panty hose.

7. Apparatus as in claim 6 wherein the transfer device has means to turn each pair of the hosiery blanks 90 degrees about its lengthwise extending axis.

* * * * *